US006523319B2

(12) United States Patent
Bockhorn et al.

(10) Patent No.: US 6,523,319 B2
(45) **Date of Patent: *Feb. 25, 2003**

(54) MOBILE RIG

(75) Inventors: Don L. Bockhorn; Johnnie A. Parker, both of Houston, TX (US)

(73) Assignee: B.F. Intent, Inc., Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/411,603

(22) Filed: Oct. 1, 1999

(65) Prior Publication Data

US 2002/0046531 A1 Apr. 25, 2002

Related U.S. Application Data

(60) Provisional application No. 60/102,885, filed on Oct. 2, 1998.

(51) Int. Cl.[7] ..... E04H 12/00

(52) U.S. Cl. ..... 52/651.01; 52/64; 52/651.05; 52/125.6; 52/143; 182/152; 182/141

(58) Field of Search ..... 52/64, 651.01, 52/651.05, 112, 66, 125.6, 116, 67, 72, 143, 646; 182/152, 141; 248/166, 170, 439

(56) References Cited

U.S. PATENT DOCUMENTS

| | | | | | |
|---|---|---|---|---|---|
| 1,919,439 | A | * | 7/1933 | Little | 52/67 |
| 2,806,747 | A | * | 9/1957 | Jaeger | 52/67 |
| 2,860,383 | A | * | 11/1958 | Heisler | 52/67 |
| 3,561,711 | A | * | 2/1971 | Dodge | 52/116 |
| 3,942,593 | A | * | 3/1976 | Reeve, Jr. et al. | 52/118 |
| 4,489,526 | A | * | 12/1984 | Cummins | 52/125.6 |
| 4,772,038 | A | * | 9/1988 | MacDonald | 280/401 |
| 5,050,353 | A | * | 9/1991 | Rogers et al. | 52/8 |
| 5,152,109 | A | * | 10/1992 | Boers | 52/66 |
| 5,185,973 | A | * | 2/1993 | Oldani | 52/64 |
| 5,291,701 | A | * | 3/1994 | Delacollette et al. | 52/67 |
| 5,450,695 | A | * | 9/1995 | Desai | 52/118 |
| 5,765,316 | A | * | 6/1998 | Kavarsky | 52/67 |
| 6,045,297 | A | * | 4/2000 | Voorhees et al. | 52/651.05 |
| 6,102,370 | A | * | 8/2000 | Johnston | 254/89 |

* cited by examiner

*Primary Examiner*—Carl D. Friedman
*Assistant Examiner*—Dennis L. Dorsey
(74) *Attorney, Agent, or Firm*—Kurt S. Myers

(57) ABSTRACT

The present invention is directed to a drilling rig base and a lower mast section that are collapsible into a compact transportable position. The base is expandable in the field to support a drilling platform and all necessary equipment, and the telescoping mast is also expanable for supporting the crown block and cables of the drawworks. More specifically, the rig of the present invention has a base having a plurality of beams, the outer beams being collapsible to a transportable position for placing on a single truck or trailer, and the A-frame lower mast section which is collapsible to a transportable position for placing on a single truck or trailer.

11 Claims, 8 Drawing Sheets

MOBILE RIG

RELATED APPLICATION

This application is based on provisional application Ser. No. 60/102,885 filed Oct. 2, 1998 by Don L. Bockhorn and Johnnie A. Parker entitled Mobile Rig Designs.

FIELD OF THE INVENTION

The present invention is directed to a mobile, collapsible drilling rig base and platform to support rotating drilling equipment. More specifically, the retractable base may be either telescoping or hinged to extend from a width suitable for transport by truck to the fill width necessary to support and stabilize a platform and a mast or derrick in the field.

BACKGROUND OF THE INVENTION

The design of rotating drilling rigs has in the past required the employment of a substantial number of trucks carrying the substructures of the drilling rig to the field. Further, substantial assembly of the substructures of the rig in the field has been required to provide a base, the rotating equipment platform and the derrick. Therefore, heavy equipment such as cranes or lifts were required at the rig site to handle the substructures.

Patents illustrating the prior art are:

U.S. Pat. No. 2,594,847 discloses a portable drilling rig substructure capable of being dismantled into a plurality of units or sections which can be loaded on a minimum number of trailers or trucks.

U.S. Pat. No. 2,594,847 discloses a portable drilling rig substructure capable of being dismantled into a plurality of units or sections which can be loaded on a minimum number of trailers or trucks.

U.S. Pat. No. 2,852,111 discloses a skid mounted, hydraulically lifted platform transportable in lowered position at a height to permit passage under bypasses, bridges, and the like.

U.S. Pat. No. 3,136,394 discloses a portable oil well drilling apparatus, in which a mast and drawworks are mounted on the same trailer and may be transported by it, in which the mast may readily be transferred from that trailer when necessary for lightening the load, and in which the drawworks can be raised from a low position on the trailer to a high position at the level of the floor of a tall substructure.

U.S. Pat. No. 3,228,151 discloses an oil well drilling apparatus which is suitable for very deep drilling, which has a tall substructure made of a minimum number of parts that are easy to assemble at ground level with oridinary oil field equipment, which does not require the drawworks and engines to be lifted to the top of a tall substructure, which does not require the use of ramps or the like in erecting the mast, which permits the substructure and the mast to be erected by the drawworks without the use of a gin pole, and in which the erection of the substructure and mast is effected easily and rapidly.

U.S. Pat. No. 3,504,749 discloses a forwardly inclined drawworks mounted on the front end of a horizontal skid frame that also supports one or more engines in a forwardly inclined position. The frame is skidded up a ramp supported by the back of a tall substructure until the frame is flat against the ramp with the drawworks upright at the top of the substructure and the engines upright below and behind the drawworks. The inclinded frame is detachably connected to the ramp.

U.S. Pat. No. 3,754,361 discloses a transportable support structure for a drilling mast and drawworks that includes spaced longitudinally extending members with lateral brace members extending therebetween to provide a support structure for a gin pole support and a drilling mast as well as an elevatable drawworks support structure which is pivotally secured to the transportable support structure.

U.S. Pat. No. 3,942,593 discloses a drilling rig that comprises a trailerable telescoping mast assembly and a separate sectionable substructure assembly therefor comprising a rig base, a working floor mounted in spaced relation above the base and a rig extension extending outwardly from the drawworks side of the rig base.

U.S. Pat. Nos. 4,009,544 and 4,024,924 disclose a structural base for a drilling rig that has sufficient longitudinal rigidity, and still supports the mast, while in a horizontal position, at a level close to the top surface of the ground. The rig has a working table or floor, of requisite height, which supports the rotary table, and which is narrower than the base of the mast and can be positioned on the structural base either before or after the nast is in position, and whether the mast is in a lowered or a raised position. The table structure is broken into a plurality of parts, each of which are fitted into the structural base and can be assembled in a lowered position and then rotated and raised into the final operating position. When the mast is in a raised position, additional support for the mast is provided by an A frame which is behind the mast and serves as a means for raising the mast by cable means over a pulley at the top of the A frame.

U.S. Pat. No. 4,305,237 discloses a compact sectionalized drilling mast, power arrangement and support means therefor.

U.S. Pat. No. 4,375,241 discloses a drilling installation comprising a base which rests on the ground, a rig, a winch, items of equipment such as a drill-pipe storage coffer, and a working floor which is raised above the base, surrounding the rig.

SUMMARY OF THE INVENTION

The present invention is directed to a drilling rig base and a lower mast section that are collapsible into a compact transportable position. The base is expandable in the field to support a drilling platform and all necessary equipment, and the telescoping mast is also expanable for supporting the crown block and cables of the drawworks. More specifically, the rig of the present invention has a base having a plurality of beams, the outer beams being collapsible to a transportable position for placing on a single truck or trailer, and the A-frame lower mast section which is collapsible to a transportable position for placing on a single truck or trailer.

DESCRIPTION OF THE PREFERRED EMBODIMENTS

The drilling rigs of the present invention are assembled for the easy transportability of the rig base and drilling platform on one trailer and the derrick on a second trailer. The rig base is collapsible to a transportable position and is easily expanded in the field. The drilling platform is connected to the base so that when placed on a trailer the base and platform are a single load on a trailer. The first section of the mast is also collapsible so that it may be placed on a single trailer. It is understood that a single trailer is used herein to include bed units or single/multiple axle load bearing units that are pulled by a single tractor or truck. The advantage of the collapsible base and first section of the mast is not only the ability to transport using a minium number of loads but the pre-assembly reduces the number of operations and time of assembly in the field.

Figure 1:
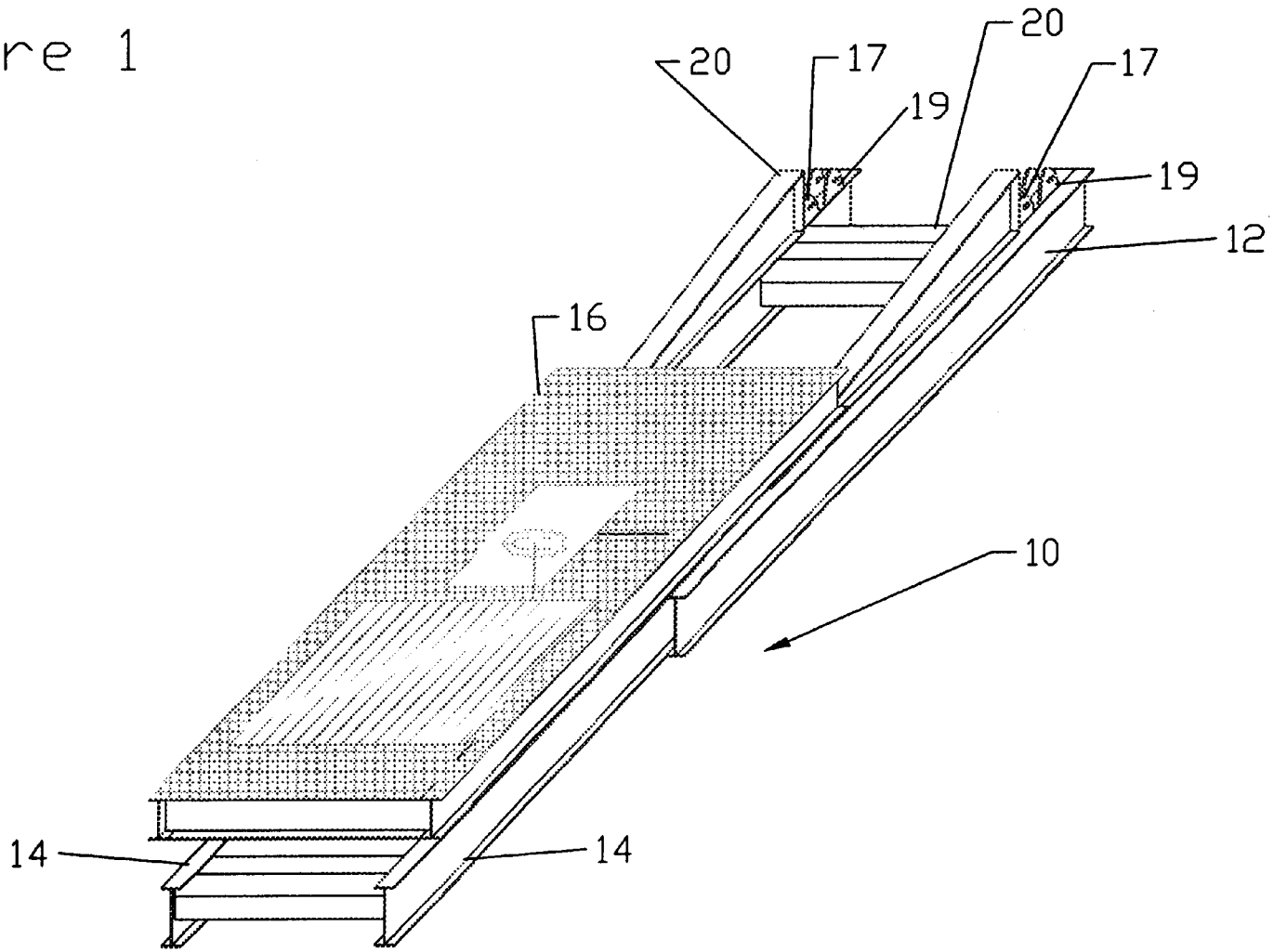
FIG. 1 is an isometric view of a base and drilling platform in the transportable position of one embodiment of a rig of the present invention.

The drilling rig base and platform of the present invention is illustrated in one embodiment shown in FIG. 1. Referring to FIG. 1, drilling rig base 10 is in the collapsible position. The base 10 has preferably four parallel beams, a pair of outer beams 12 and a pair of inner beams 14. The beams may be of channel or I beam construction and of a single piece of metal or welded and/or bolted sections. A platform 16 is secured to the inner beams 14. A pair of trunnions 17 and 19 are mounted on the beams 14 and back legs 20 are pinned to the trunnions. In the lowered position only one pin and trunnion 17 are used to secure the platform 16 in the transportable position, the position shown in FIG. 1. The width of the collapsed base 10 can be less than 12 feet, a width that is acceptable for highway travel.

Figure 2:
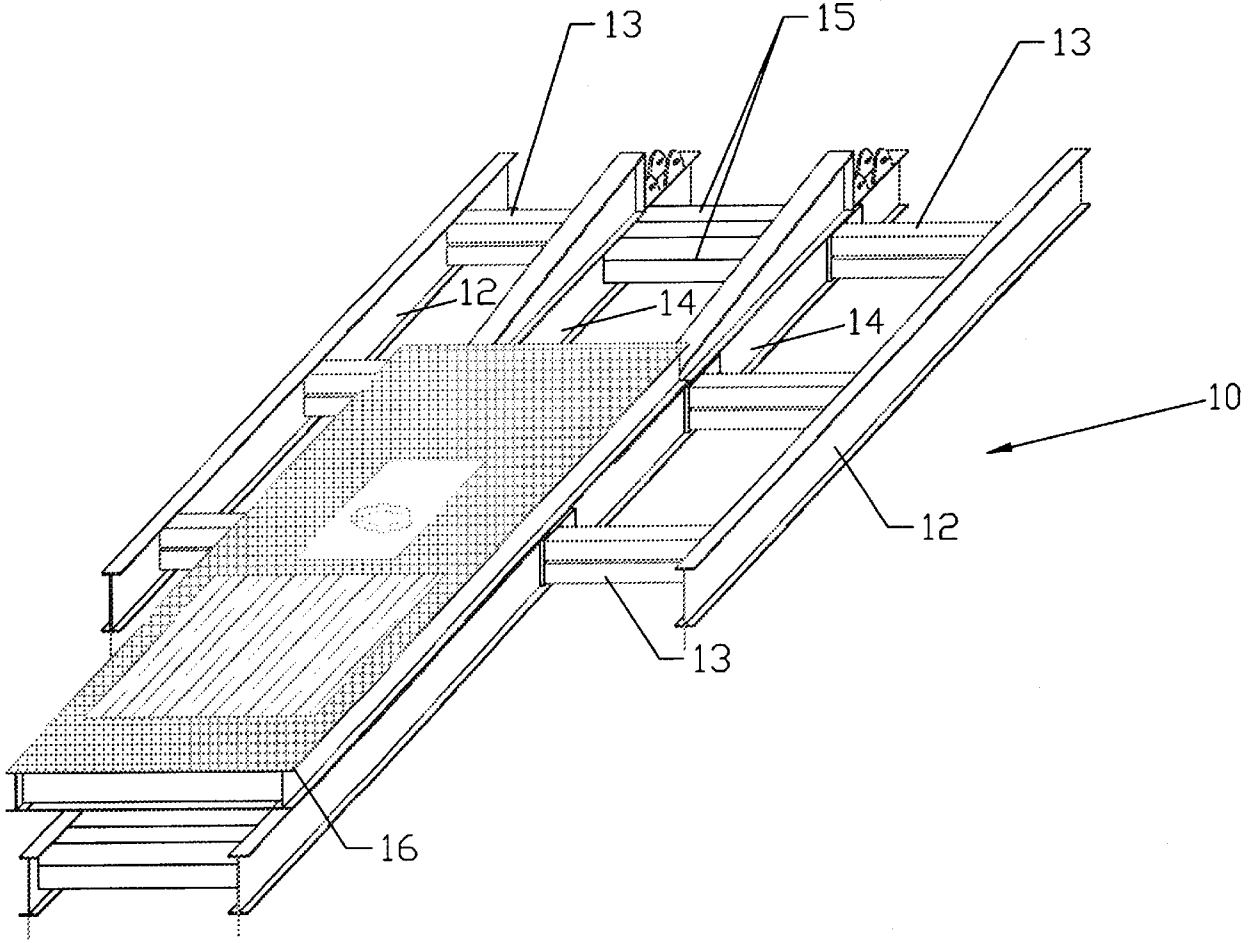
FIG. 2 is an isometric view of the base and drilling platform of the FIG. 1 embodiment with the base in the expanded position.

After being placed on a leveled site for drilling a well, the base 10 is expanded in a horizontal plane as shown in FIG. 2. The base 10 may also be expanded on the trailer before being placed on the ground site. In this embodiment, the beams 12 are telescopically expandable or collapsible horizontally due to cross-beams 13 and 13' that are welded and/or bolted to beams 12 and slide within the channel beams 15 and 15', respectively, that are welded and/or bolted between beams 14. The sliding of the cross-beams 13 and 13' may be enhanced by rollers or other mechanical arrangements but such enhancement is not part of this invention. It is the object that the beams 12 and 14 provide a solid and level base on the leveled site for drilling the well. The expanded base 10 has a width that can exceed twice the transportable width; for example, a base may be expanded from 12 feet to 30 feet. It is clear that a 30 foot base can not be transported any great distance; however a 30 foot base of the present invention is capable of being transported on the road or over water in the collapsed transportable position.

Figure 3:
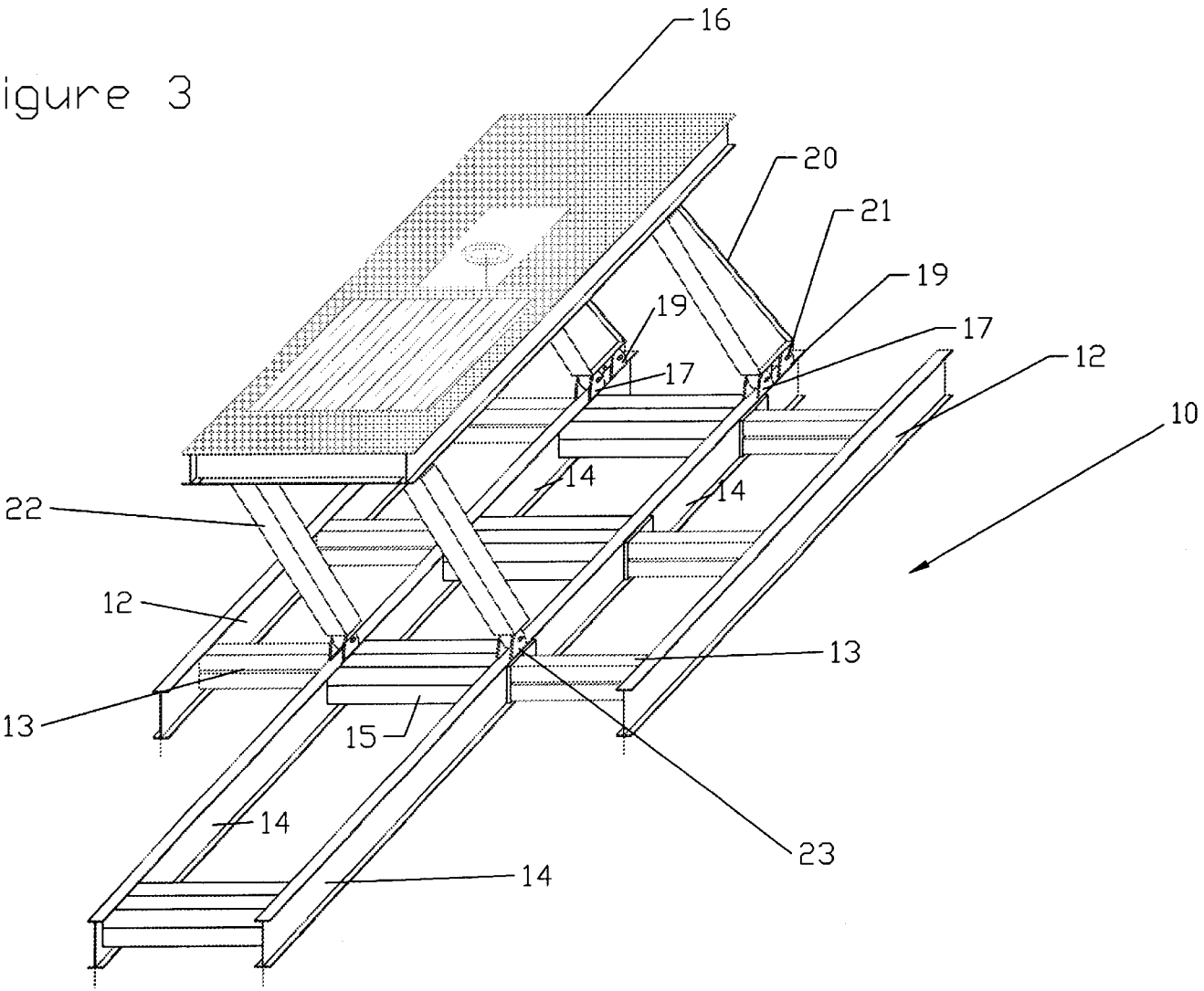
FIG. 3 is an isometric view of the base and drilling platform of the FIG. 1 embodiment with the base in the expanded position and the platform partially raised.

Referring now to FIG. 3, the base 10 has been set on the site for drilling a well and the beams 12 expanded to the desired width, the platform 16 is then raised. FIG. 3 shows the platform in a partially raised position. The front legs 22 are pinned in trunnions 23 before transit as are legs 20 pinned to trunnions 17. Upon raising the platform 16 to the vertical position, legs 20 are further pinned to trunnions 19 by pins 21.

Figure 4:
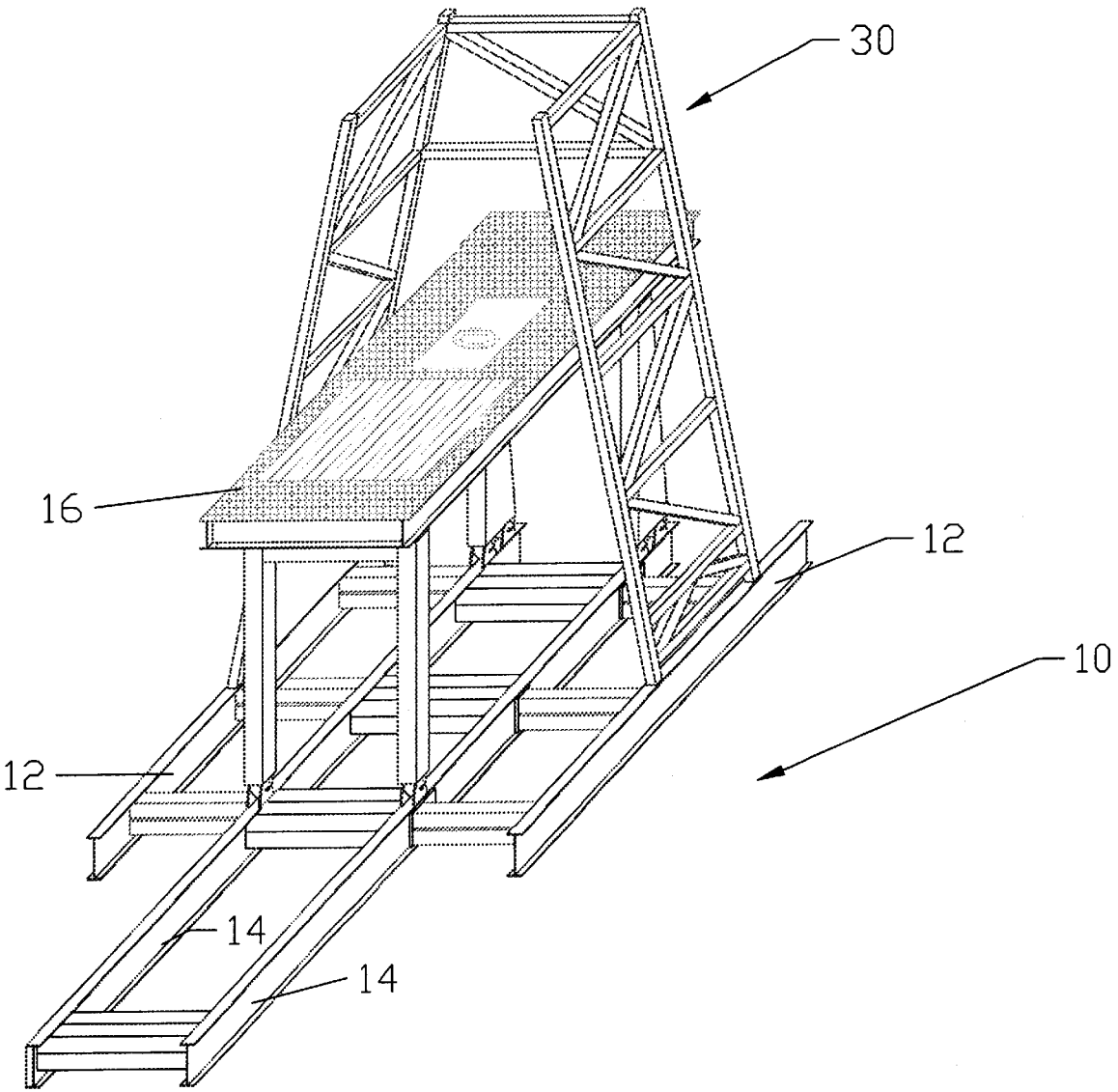
FIG. 4 is an isometric view of the base and drilling platform of the FIG. 1 embodiment with the base in the expanded position and the platform fully raised.

Referring now to FIG. 4, the platform 16 is in the full vertical position and the lower mast section 30 (the starting leg section) is attached to the beams 12 of the base 10. There are additional supporting structure for the lower mast section that will be set forth in more detail hereinafter.

Figure 5:
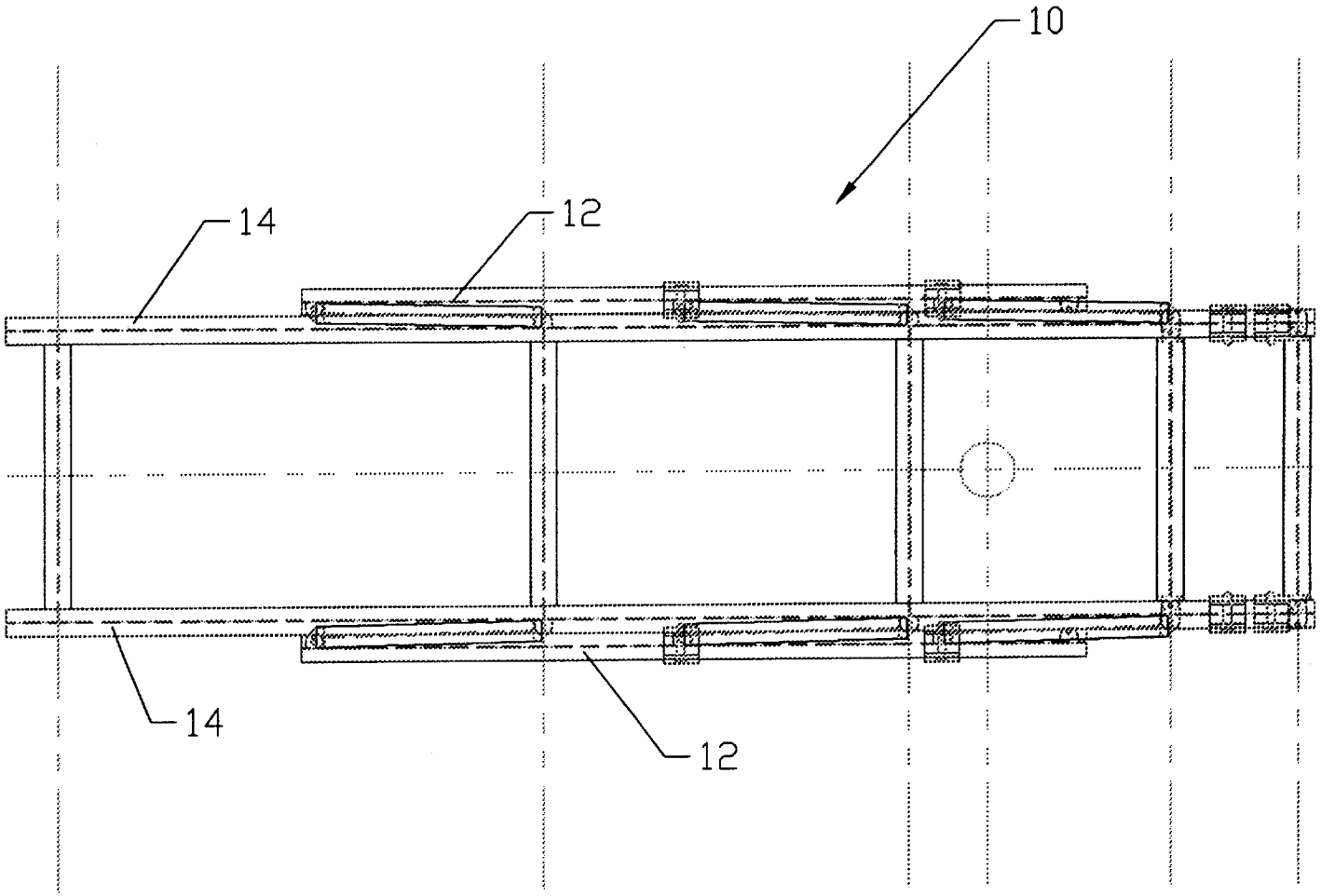
FIG. 5 is a top view of a base and drilling platform in the transportable position of a second embodiment of a rig of the present invention.
Figure 6:
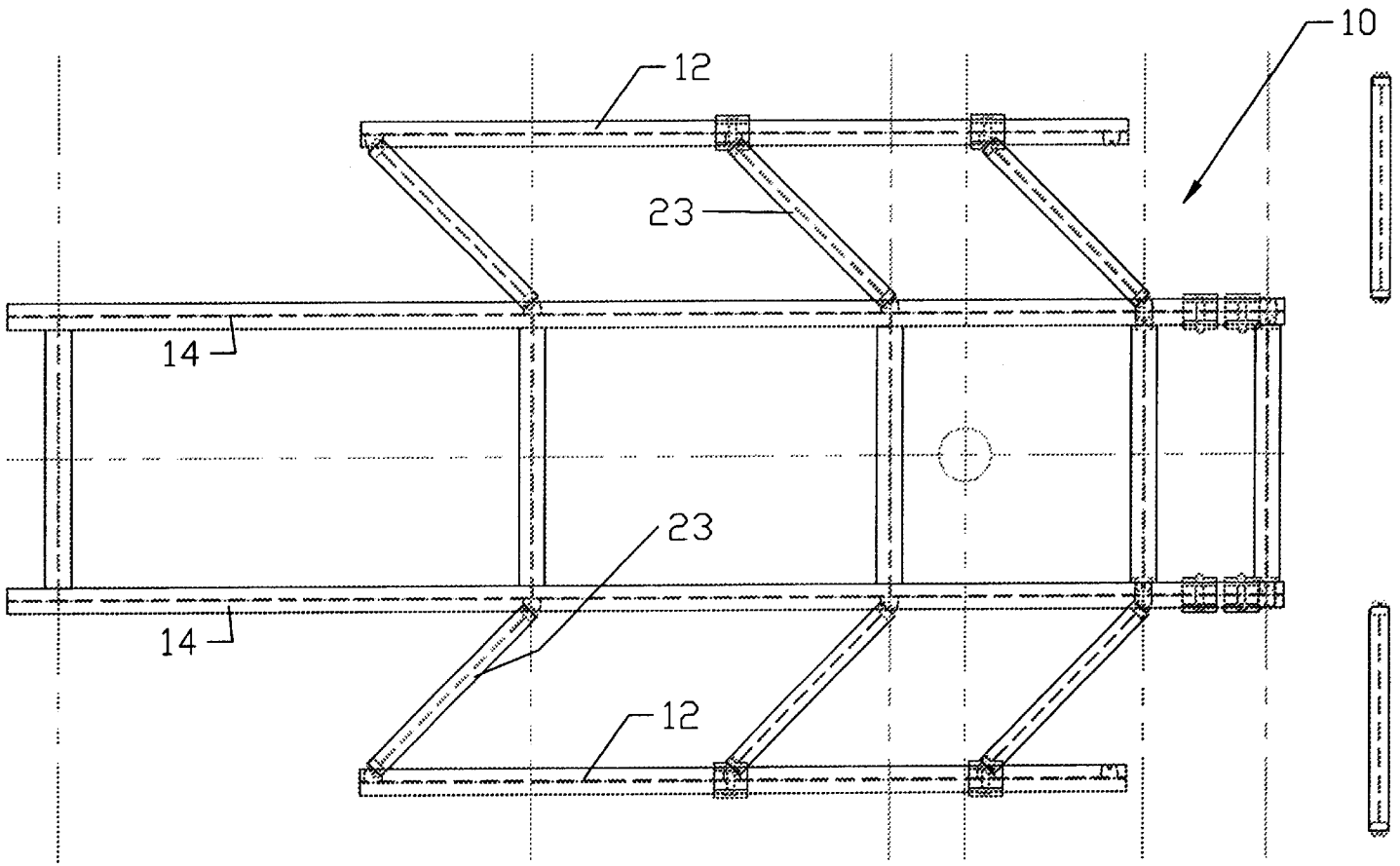
FIG. 6 is a top view of the base and drilling platform of the FIG. 5 embodiment with the base in the partially expanded position.

Referring to FIGS. 5 and 6, another embodiment of a base 10 of the present invention is shown. In this embodiment the beams 12 are hingedly attached to the beams 14. The transportable position of the beams 12 is shown in FIG. 5 and the partially expanded position of the beams 12 is shown in FIG. 6. In this embodiment the plurality (6 beams are shown) of cross-beams 23 are hinged at one end to beam 12 and the other end to beam 14. Upon arriving at the site for drilling a well, the beams 12 are expanded position such that the cross-beams 22 are at right angles to the beams 12 and 14. The advantage of the base of the present invention is that essentially all assembly operations are carried out in a shop and tested before placing the base 10 in the field. Special skilled personnel such as welders or fitters and the use of special equipment such as cranes are not required in the field to set up the base of the present invention. The expansion of base 10 may be accomplished with wenches or equipment used ordinarily at oil field sites.

Another aspect of the present invention is the collapsible first section of the mast. The major objective of the present invention is to have a fully assembled rig that is easily transported to the site for drilling a well. Thus, the two major components of structure to meet that objective are the collapsible base as shown above and the collapsible first section of the mast as will be described hereinafter.

Figure 7:
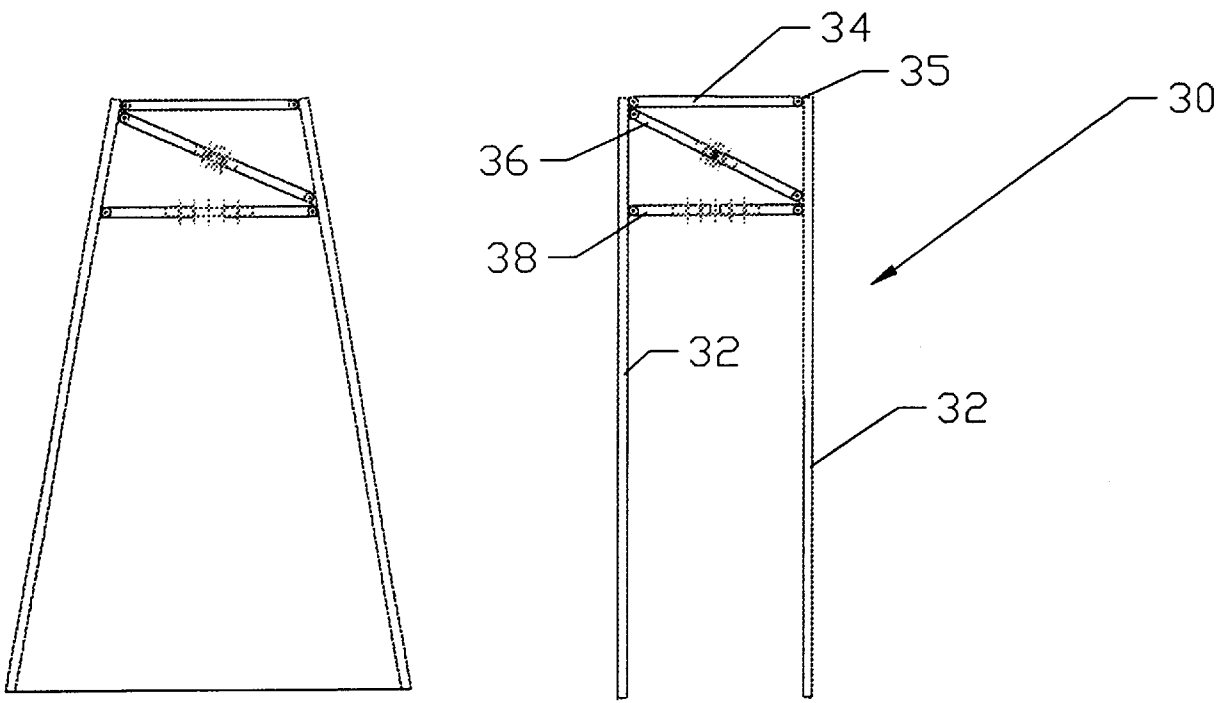
FIG. 7 is a back view of an expandable A-frame lower mast section in the transportable position.
Figure 8:
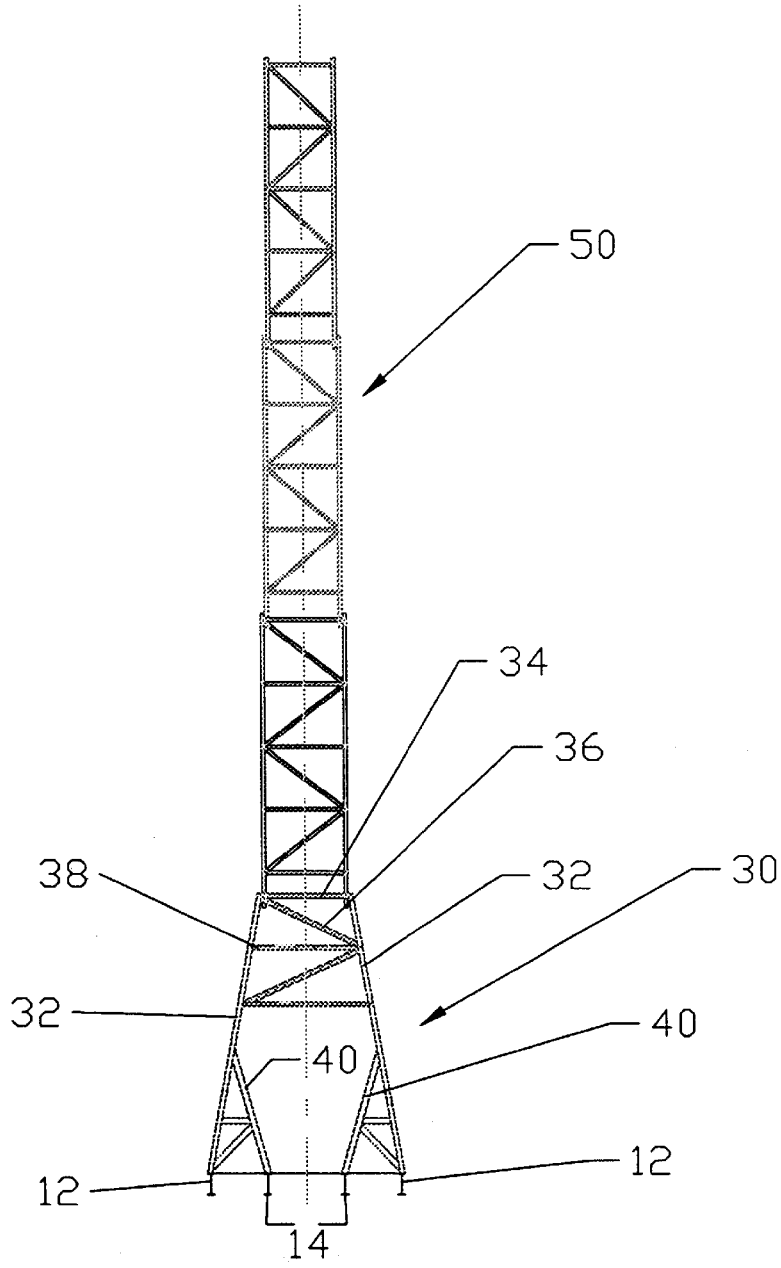
FIG. 8 is an back view of a base and drilling platform of an embodiment of the present invention with the A-frame mast support of the present invention.

Referring to FIGS. 7, 8 and 4, a lower mast section 30 is shown in FIG. 7 in the collapsed position. The lower mast section 30 has four mast legs 32 that are connected by a universal joint 35 to a rectangular mast base 34. The universal joint 35 may be pins that connect the legs 32 to the rectangular base 34. Expandable braces 36, in the diagonal between legs 32, and 38, horizontally between legs 32, are shown in the collapsed position. In the field the lower section 30 of the mast is expanded by expanding braces 36 and 38 as shown in FIG. 8. The legs 32 of the lower mast section 30 are secured to beams 12. Drop legs 40 are hinged to mast legs 32 and are secured to beams 14. The weight of the mast is thus distributed to both beams 12 and 14 of the base 10. A telescoping mast 40 is then secured to the rectangular mast base 34. The telescoping mast is assembled in sections of smaller cross-section and are easily raised in position in the field.

The present invention has been illustrated with specific embodiments; however, various changes in the size, shape, materials of construction as well as the details of the illustrated construction may be made without departing from the spirit of the invention.

What is claimed is:

1. A mobile, collapsible drilling rig base and drilling platform which comprises:

a base having a plurality of parallel beams; said beams beams being in a horizontal plane and including inner beams and outer beams: said outer beams being collapsible in said horizontal plane to a transportable position; and a drilling platform attached to said base that is elevatable above said base.

2. A mobile, collapsible drilling rig base and drilling platform according to claim 1 wherein said base has four parallel beams, two outer beams and two inner beams.

3. A mobile, collapsible drilling rig base and drilling platform according to claim 2 wherein each of said outer two parallel beams are telescopically connected to one of said inner beams.

4. A mobile, collapsible drilling rig base and drilling platform according to claim 2 wherein each of said outer two parrallel beams are connected by a hinge to one of said inner beams.

5. A mobile, collapsible drilling rig base and drilling platform according to claim 2 wherein said platform is connected by hinges to said inner beams.

6. A mobile drilling rig which comprises:

a rig base having a plurality of parallel beams; said beams being in a horizontal plane and including inner beams and outer beams; said outer beams being expandable from a collapsible position to an extended spaced position;

a drilling platform attached to said base that is elevatable above said base;

a rectangular mast base;

four leg beams each having an upper end and a lower end; said upper end of said beams attached to said mast base by universal joints; and means to spread said leg beams to a position where said lower end of said beams are attached to the expanded outer beams of said rig base.

7. A mobile drilling rig according to claim 6 wherein said base has four parallel beams, two outer beams and two inner beams.

8. A mobile drilling rig according to claim 7 wherein each of said outer two parallel beams are telescopically connected to one of said inner beams.

9. A mobile drilling rig according to claim 7 wherein each of said outer two parallel beams are connected by a hinge to one of said inner beams.

10. A mobile drilling rig according to claim 8 wherein each mast leg has a drop leg connected to an inner beam.

11. A mobile drilling rig according to claim 9 wherein each mast leg has a drop leg connected to an inner beam.

* * * * *